US005578895A

United States Patent [19]

Oshima

[11] Patent Number: 5,578,895

[45] Date of Patent: Nov. 26, 1996

[54] SPARK PLUG HAVING A NOBLE METAL ELECTRODE TIP

[75] Inventor: Takafumi Oshima, Nagoya, Japan

[73] Assignee: NGK Spark Plug Co., Ltd., Nagoya, Japan

[21] Appl. No.: 639,002

[22] Filed: Apr. 26, 1996

Related U.S. Application Data

[63] Continuation of Ser. No. 265,340, Jun. 24, 1994, abandoned.

[30] Foreign Application Priority Data

Jul. 26, 1993 [JP] Japan ..... 5-184207

[51] Int. Cl.[6] ..... H01T 13/20

[52] U.S. Cl. ..... 313/141; 313/144; 313/142

[58] Field of Search ..... 313/141, 142, 313/118, 136, 138, 143; 123/169 EL, 169 R; 420/441, 442, 443, 452, 455, 459

[56] References Cited

U.S. PATENT DOCUMENTS

| | | | |
|---|---|---|---|
| 3,653,881 | 4/1972 | McCann et al. | 75/171 |
| 4,329,174 | 5/1982 | Ito et al. | 420/433 |
| 4,581,558 | 4/1986 | Takamura et al. | 313/141 |
| 4,670,864 | 6/1987 | Kagawa et al. | 313/141 |
| 4,771,210 | 9/1988 | Möhle et al. | 313/141 |
| 4,853,582 | 8/1989 | Sato et al. | 313/141 |
| 5,101,135 | 3/1992 | Oshima | 313/142 |
| 5,347,193 | 9/1994 | Oshima et al. | 313/141 |

OTHER PUBLICATIONS

Abstract of Japanese Patent Publication 5–101869, vol. 17, No. 450 (E–1416), 23 Apr. 1993.

Patent Abstracts of Japan, vol. 8 No. 71 (C–217) JP–A–58 224140, 26 Dec. 1983.

*Primary Examiner*—Nimeshkumar Patel

*Attorney, Agent, or Firm*—Sughrue, Mion, Zinn, Macpeak & Seas

[57] ABSTRACT

In a spark plug which has an electrode metal made from a heat- and erosion-resistant nickel alloy whose front end has a noble metal tip made of iridium or ruthenium, the electrode metal has a thermal conductivity of at least 30 W/m·K so as to avoid rapid temperature rise in the noble metal tip to thereby minimize oxidation-evaporation and attendant wear thereof.

5 Claims, 4 Drawing Sheets

SPARK PLUG HAVING A NOBLE METAL ELECTRODE TIP

This is a Continuation of application Ser. No. 08/265,340 filed Jun. 24, 1994, now abandoned.

BACKGROUND OF THE INVENTION

1. Field of the Invention

This invention relates to a spark plug which has an electrode metal made from a heat-and erosion-resistant nickel alloy whose front end has a noble metal tip made of iridium or ruthenium.

2. Description of Prior Art

In a spark plug electrode for an internal combustion engine, a noble metal tip is used which has been made of iridium or ruthenium since they are superior in spark-erosion to other noble metals such as platinum or the like. This is because iridium and ruthenium have a higher melting point (2447° C., 2310° C.) than that of platinum by 600°~700° C.

However, iridium and ruthenium are particularly vulnerable to an oxidation-based evaporation at high temperature so as to be quickly corroded when the temperature exceeds a critical point. That is to say, wear of the noble metal tip is accelerated at the critical temperature when made of iridium or ruthenium.

In order to avoid the rapid wear of the noble metal tip, Japanese Patent Application No. 4-350 introduces a center electrode 100 for a spark plug as shown in FIG. 6. In the center electrode 100, a recess 102 is provided on a front end of an electrode metal 101, and a noble metal tip 103 is fixedly placed in the recess 102. The electrode metal 101 clads a heat-conductive core 104 whose front end 104*a* is located near a front end 103*a* of the noble metal tip 103. The heat-conductive core 104 works to draw a considerable amount of heat from the noble metal tip 103 so as to keep the temperature of the tip 103 from exceedingly rising.

In this instance, the electrode metal 101 is made of Inconel 600 so as to satisfactorily resist a thermal stress caused by a thermal expansional difference between the noble metal tip 103 and the front end of an electrode metal 101. The Inconel 600 has a good physical strength at high temperature, but not a sufficient thermal conductivity to draw the heat from the noble metal tip 103.

Therefore, it is an object of the invention to provide a spark plug which is capable of maintaining the temperature of a noble metal tip relatively low so as to significantly reduce the wear to which noble metal tip is subjected.

SUMMARY OF THE INVENTION

According to the invention, there is provided a spark plug having an electrode metal made from a heat-and erosion-resistant nickel alloy whose front end has a noble metal tip made of iridium or ruthenium, the electrode metal has a thermal conductivity of 30 W/m·K or greater than 30 W/m·K.

According further to the invention, the electrode metal clads a heat-conductive core, and a front end of the core is in direct contact with the noble metal tip. Otherwise, the front end of the core is located near the noble metal tip within a range of 1.5 mm.

Still further, the noble metal tip is laser welded to the front end of the electrode metal by forming a solidified alloy layer between the noble metal tip and the electrode metal all through their circumferential length.

With occurrences of spark discharges between electrodes and temperature rise in a combustion chamber, the noble metal tip is exposed to high temperature environment. In this instance, the electrode metal draws a considerable amount of heat from the noble metal tip due to the reason that the electrode metal has a good thermal conductivity of 30 W/m·K or greater than 30 W/m·K. This avoids an abnormal temperature rise of the noble metal tip to prevent the oxidation-based evaporation of iridium or ruthenium so as to significantly reduce the wear to which the noble metal tip is subjected.

With the front end of the core located near the noble metal tip within thee range of 1.5 mm, the heat-drawing effect is facilitated from the noble metal tip to maintain the temperature of the tip sufficiently low so as to minimize the wear to which the noble metal tip is subjected.

With the noble metal tip laser welded to the front end of the electrode metal by forming a solidified alloy layer between the noble metal tip and the electrode metal all through their circumferential length, it is possible to attain a sufficient physical strength of the solidified alloy layer between the noble metal tip and the electrode metal without using Inconel 600.

These and other objects and advantages of the invention will be apparent upon reference to the following specification, attendant claims and drawings.

DETAILED DESCRIPTION OF THE EMBODIMENT OF THE INVENTION

Figure 1:
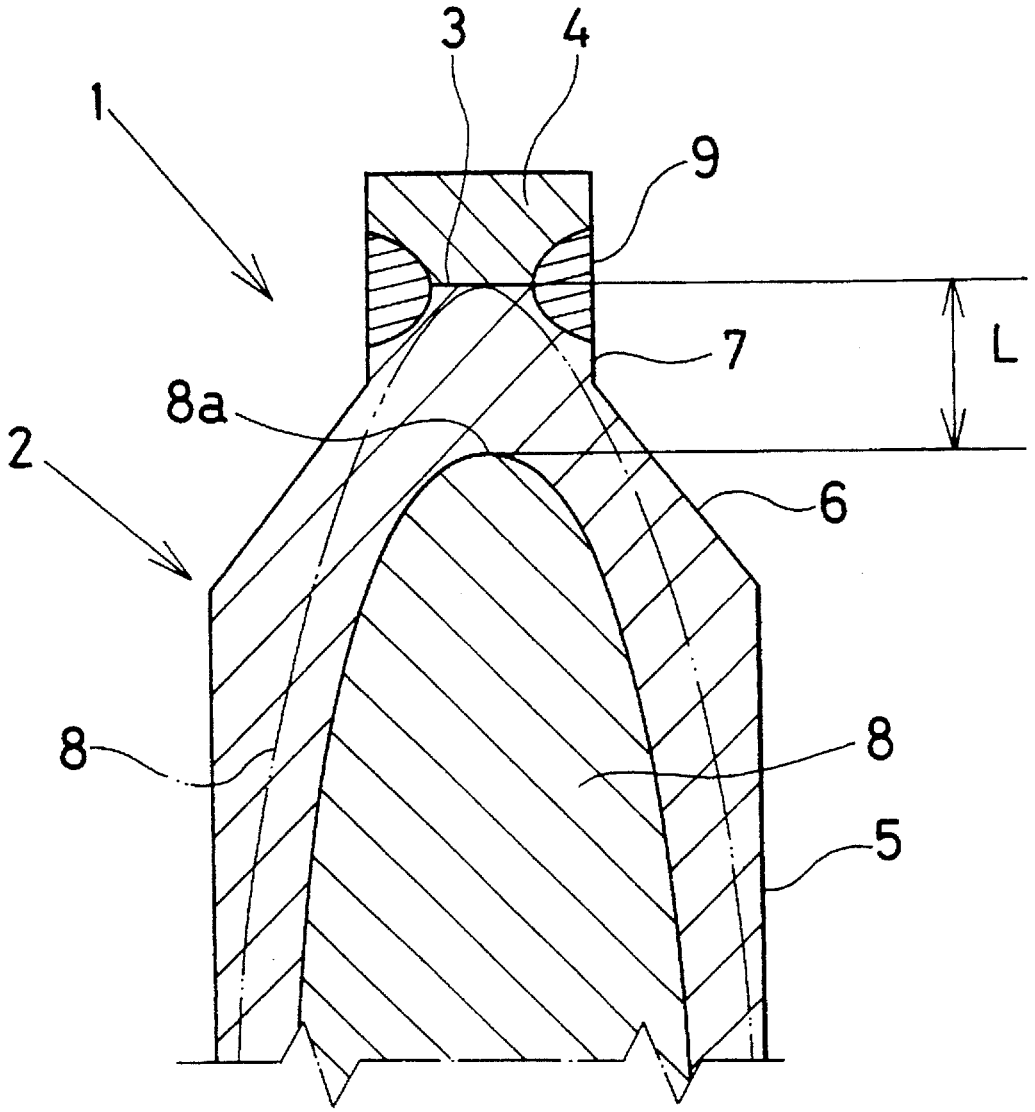
FIG. 1 is a longitudinal cross sectional view of a lower portion of a center electrode of a spark plug.

Referring to FIG. 1 which shows a lower portion of a center electrode 1 of a spark plug (not shown), the center electrode 1 has a heat- and erosion-resistant electrode metal 2 made of nickel. To a front end 3 of the electrode metal 2, a noble metal tip 4 is secured which is made of iridium or rethenium to provide it with spark-erosion resistant property.

Upon analyzing with a laser flash method, the electrode metal 2 has a thermal conductivity of at least 30 W/m·K Materials employed in the electrode metal 2 are described in detail hereinafter. The electrode metal 2 further has a barrel portion 5 and a cone portion 6 extended from the barrel portion 5 to a diameter-reduced neck 7. The diameter-reduced neck 7 measures 0.85 mm in diameter, and continuously leading to the front end 3 of the electrode metal 2.

In the electrode metal 2, a heat-conductive core 8 is concentrically embedded which is made of copper or copper alloy. A front end 8*a* of the core 8 is located near the noble metal tip 4 within a range of 1.5 mm. Otherwise, the front end 8*a* of the core 8 is in direct contact with the noble metal tip 4 as shown at phantom line in FIG. 1.

The noble metal tip 4 is made from an iridium-or ruthenium-based alloy containing oxides of rare earth metals. The noble metal tip 4 is laser welded to the front end 3 of the electrode metal 2 by forming a solidified alloy layer 9 between the noble metal tip 4 and the front end 3 of the electrode metal 2 all through their circumferential length i.e., around the circumference. The solidified alloy layer 9 makes it possible to physically strongly bond the noble metal tip 4 to the front end 3 of the electrode metal 2.

Figure 2A:
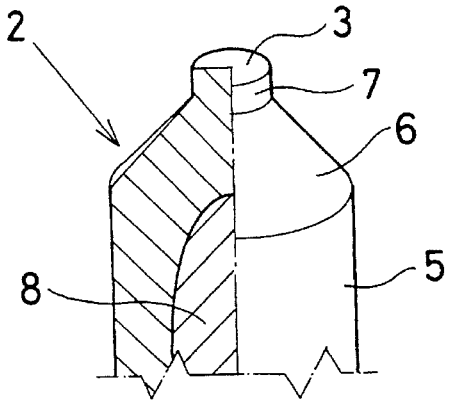
FIGS. 2*a*~2*c* are sequential views showing how the center electrode is manufactured.

A method of bonding the noble metal tip 4 to the front end 3 of the electrode metal 2 is as follows:

(i) The heat-conductive core 8 is concentrically embedded in the electrode metal 2 by means of e.g. extrusion. The electrode metal.2 is machined to have the cone portion 6, the barrel portion 5 and the diameter-reduced neck 7 by means of plastic working or cutting procedure as shown in FIG. 2*a*. Upon applying the extrusion process, the front end 8*a* of the core 8 is located near the noble metal tip 4 within the range of 1.5 mm.

Figure 2B:
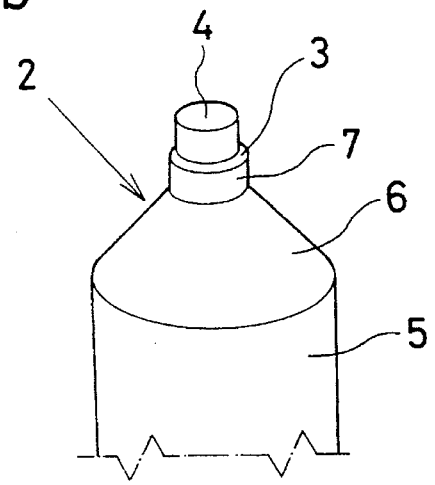

(ii) The noble metal tip 4 is formed into a disc-shaped configuration to measure 0.8 mm in diameter and 0.5 mm in thickness. Then, the noble metal tip 4 is concentrically located on the front end 3 of the electrode metal 2 as shown in FIG. 2*b*.

(iii) By using a YAG laser welder machine for example, laser beams (Lb) are applied to an interface between the noble metal tip 4 and the front end 3 of the electrode metal 2 all through their circumferential length while appropriately depressing the noble metal tip 4 against the front end 3 of the electrode metal 2 by means of a conical jig 10.

Figure 2C:
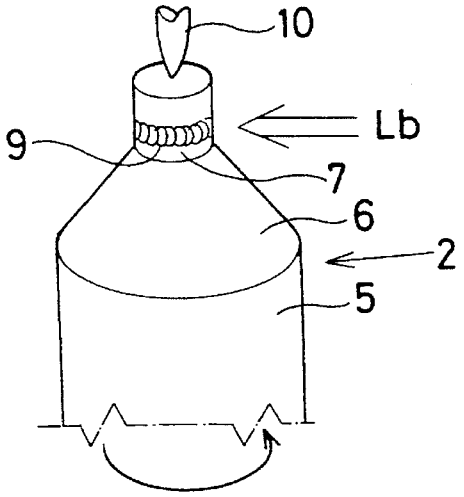

Thus, the laser welding procedure eventually forms the solidified alloy layer 9 at the interface to physically strongly bond the noble metal tip 4 to the front end 3 of the electrode metal 2 as shown in FIG. 2*c*.

In order to analyze how the wear-resistant property of the noble metal tip 4 is improved depending on the thermal conductivity (W/m·K) of the electrode metal 2, specimens A~H were prepared by changing constituents of the electrode metal 2 as shown in the following Table.

Figure 5:
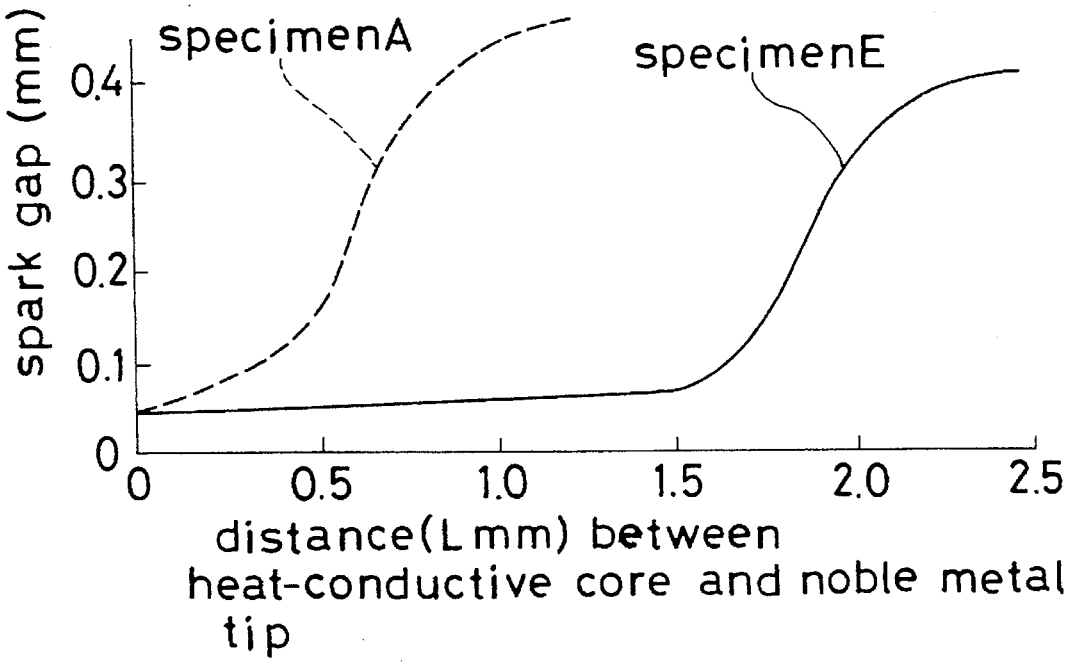
FIG. 5 is a graph showing a relationship between a spark gap (mm) and a distance (L mm) measured from a front end of the heat conductive core to the noble metal tip.

FIG. 5 shows how the spark gap (mm) increases depending on a distance (L mm) between the noble metal tip 4 and the front end 8*a* of the heat-conductive core 8. In FIG. 5, the solid line curve represents the specimen E whose thermal conductivity (31 W/m·K) is greater than 30 W/m·K, while the broken line curve represents the specimen A whose thermal conductivity (12 W/m·K) is smaller than 30 W/m·K.

Figure 3:
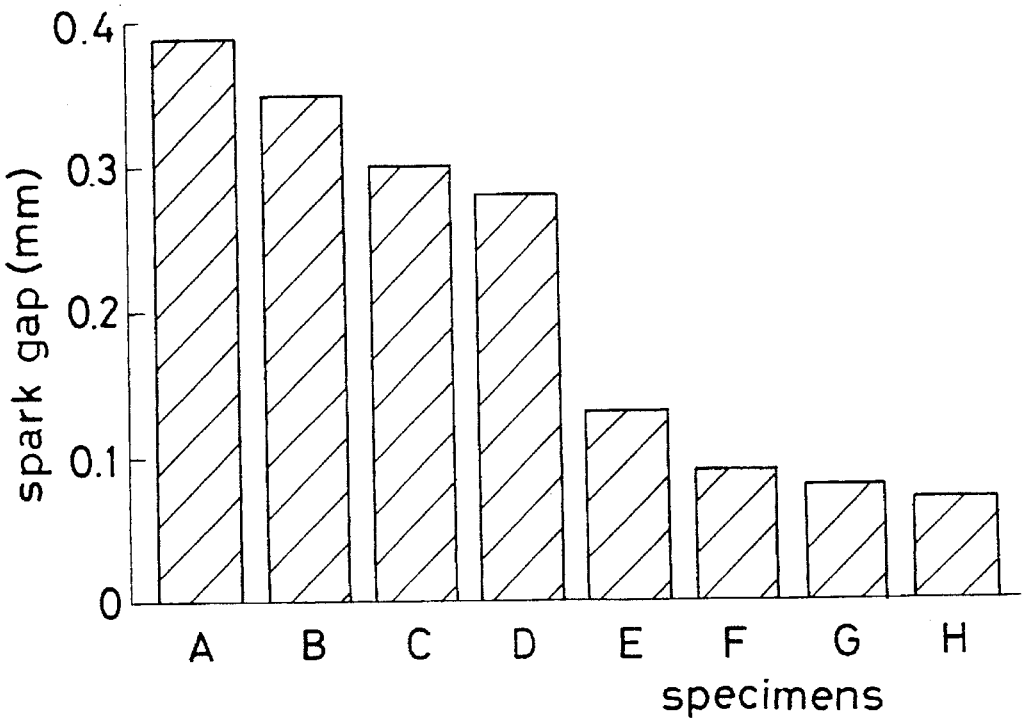
FIG. 3 is a graph showing a relationship between a spark gap (mm) and specimens (A~H) employed to an electrode metal.

It is apparent from FIG. 3 that the increase of the spark gap (mm) is effectively controlled when the thermal conductivity is Greater than 30 W/m·K as opposed to the case in which the thermal conductivity is smaller than 30 W/m·K.

Figure 4:
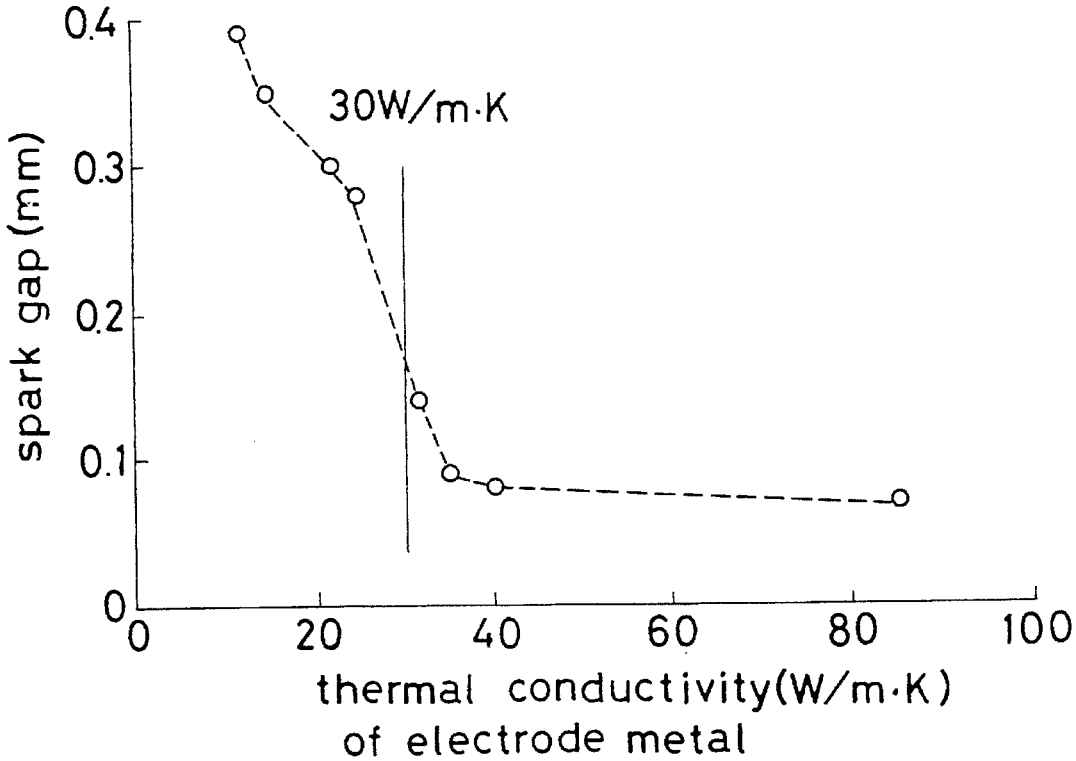
FIG. 4 is a graph showing a relationship between a spark gap (mm) and thermal conductivity (W/m·K) of the electrode metal.

It is also apparent from FIG. 4 that the thermal conductivity greater than 30 W/m·K rapidly drops the increase of the spark gap (mm).

As understood by FIG. 5, the increase of the spark gap (mm) is kept small until the distance (L) exceeds 1.5 mm when the thermal conductivity is greater than 30 W/m·K (specimen E) in opposition to the case in which the spark gap rapidly increases when the distance (L) exceeds 0.5 mm when the thermal conductivity is smaller than 30 W/m·K (specimen A). That is to say, the thermal conductivity greater than 30 W/m·K enables to avoid the rapid temperature rise of the noble metal tip 4 to minimize its wear substantially irrespective of the distance (L) between the heat-conductive core 8 and the noble metal tip 4.

Figure 6:
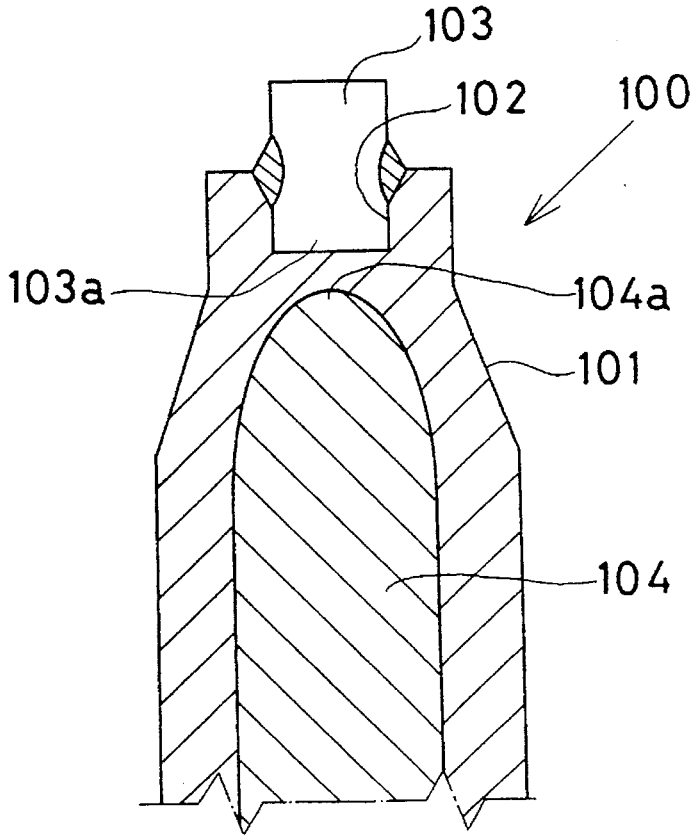
Fig. 6 Prior Art
FIG. 6 is a longitudinal cross sectional view of a lower portion of a prior,art center electrode.

Reverting to the prior art center electrode 100 in FIG. 6, the noble metal tip 103 is placed in the recess 102 which is provided on the front end of the electrode metal 101. This requires a step to make the recess 102 so as to increase the manufacturing cost.

When the diameter of the recess 102 is greater than that of the noble metal tip 103, the noble metal tip 103 is liable to tilt in the recess, thus making it difficult to stably bond the tip 103 to the front end of the electrode metal 101.

When the diameter of the recess 102 is smaller than that of the noble metal tip 103, it is difficult to place the tip 103 in the recess 102, thus taking a more time to bond the noble metal tip 103 to the electrode metal 101. This is particularly disadvantageous when reducing it to mass production.

TABLE

| | Cr (wt %) | Fe (wt %) | Si (wt %) | Mn (wt %) | Others (wt %) | Ni (wt %) | thermal conductivity (wt %) | trademark |
|---|---|---|---|---|---|---|---|---|
| specimen A | 9 | 24 | — | — | 2 | 65 | 12 W/m · K | Inconel 601 |
| specimen B | 8 | 16 | — | — | — | 76 | 15 W/m · K | Inconel 600 |
| specimen C | 10 | — | 2 | — | 2 | 84 | 22 W/m · K | |
| specimen D | 10 | — | — | — | — | 90 | 25 W/m · K | |
| specimen E | 3 | — | 2 | 2 | — | 93 | 31 W/m · K | |
| specimen F | 1.5 | — | 1.5 | 2 | — | 95 | 35 W/m · K | |
| specimen G | 1 | — | 1 | 0.5 | — | 97.5 | 40 W/m · K | |
| specimen H | — | — | — | — | — | 100 | 85 W/m · K | pure nickel |

The specimens A~H were prepared and mounted on the spark plug, an endurance test was carried out with the spark plug installed on six-cylinder, 2000 cc internal combustion engine which was operated at 5500 rpm with full load for 400 hours. As shown in FIG. 3, it was found from the endurance test result how a spark gap (mm) increases depending wear of the noble metal tip 4. FIG. 4 shows a relationship between the thermal conductivity (W/m·K) of the electrode metal 2 and an increase of the spark gap (mm) caused by the wear of the noble metal tip 4.

On the contrary, according to the invention, the noble metal tip 4 is physically strongly welded to the electrode metal 2 by placing the noble metal tip 4 on the front end 3 of the electrode metal 2, and thus eliminating the above drawbacks to provide a long-lasting spark plug with low cost so as to keep sufficiently low temperature of the tip.

It is appreciated that the noble metal tip 4 may be welded to a ground electrode instead of the center electrode. In this instance, the ground electrode may have a heat-conductive core embedded in an electrode metal.

It is observed that the noble metal tip 4 may be secured to a side portion all or part of the electrode metal 2 instead of the front end 3 of the electrode metal 2.

It is also appreciated that the noble metal tip 4 may be secured to the front end 3 of the electrode metal 2 by means of electron beam welding or the like.

While the invention has been described with reference to the specific embodiments, it is understood that this description is not to be construed in a limiting sense in as much as various modifications and additions to the specific embodiments may be made by skilled artisan without departing from the spirit and scope of the invention.

What is claimed is:

1. A spark plug having an electrode metal made form a heat- and erosion-resistant nickel alloy whose front end has a noble metal tip made of a metal from the group consisting of iridium and ruthenium, wherein:

the electrode metal has a thermal conductivity of at least 30 W/m·K so as to avoid rapid temperature rise in the noble metal tip to thereby minimize oxidation-evaporation and attendant wear thereof.

2. A spark plug as recited in claim 1, wherein the electrode metal clads a heat-conductive core, and a front end of the core is in direct contact with the noble metal tip.

3. A spark plug as recited in claim 2, wherein the noble metal tip is laser welded to the front end of the electrode metal by forming a solidified alloy layer between the noble metal tip and the electrode metal all through their circumferential length.

4. A spark plug as recited in claim 1, wherein the electrode metal clads a heat conductive core and the front end of the core is located within a range of 1.5 mm from the noble metal tip.

5. A spark plug as recited in claim 1, wherein the noble metal tip is laser welded to the front end of the electrode metal by forming a solidified alloy layer between the noble metal tip and the electrode metal all through their circumferential length.

* * * * *